US010790581B2

(12) United States Patent
Spick et al.

(10) Patent No.: US 10,790,581 B2
(45) Date of Patent: Sep. 29, 2020

(54) METHOD FOR MANUFACTURING A SENSOR PROVIDED WITH AT LEAST ONE ULTRAHIGH-FREQUENCY ANTENNA AND ULTRAHIGH-FREQUENCY SENSOR THUS OBTAINED

(71) Applicants: Continental Automotive France, Toulouse (FR); Continental Automotive GmbH, Hannover (DE)

(72) Inventors: Gabriel Spick, Toulouse (FR); Bertrand Vaysse, Tornefeuille (FR); Maxime Micheau, Toulouse (FR)

(73) Assignees: Continental Automotive France, Toulouse (FR); Continental Automotive GmbH, Hannover (DE)

( * ) Notice: Subject to any disclaimer, the term of this patent is extended or adjusted under 35 U.S.C. 154(b) by 0 days.

(21) Appl. No.: 16/480,722

(22) PCT Filed: Feb. 9, 2018

(86) PCT No.: PCT/FR2018/050319

§ 371 (c)(1),
(2) Date: Jul. 25, 2019

(87) PCT Pub. No.: WO2018/154208

PCT Pub. Date: Aug. 30, 2018

(65) Prior Publication Data

US 2019/0393591 A1 Dec. 26, 2019

(30) Foreign Application Priority Data

Feb. 24, 2017 (FR) ..... 17 51479

(51) Int. Cl.
*H01Q 1/00* (2006.01)
*H01Q 1/32* (2006.01)
(Continued)

(52) U.S. Cl.
CPC ..... *H01Q 1/3241* (2013.01); *H01Q 1/38* (2013.01); *H01Q 1/2291* (2013.01); *H01Q 1/422* (2013.01)

(58) Field of Classification Search
None
See application file for complete search history.

(56) References Cited

U.S. PATENT DOCUMENTS

2007/0164907 A1 7/2007 Gaucher et al.
2008/0272981 A1 11/2008 Gagne et al.
(Continued)

FOREIGN PATENT DOCUMENTS

FR 3025641 A1 3/2016
JP 2015133605 A 7/2015

OTHER PUBLICATIONS

International Search Report and Written Opinion for International Application No. PCT/FR2018/050319, dated May 4, 2018—9 pages.
(Continued)

*Primary Examiner* — Anh Q Tran
(74) *Attorney, Agent, or Firm* — RatnerPrestia

(57) ABSTRACT

A method for manufacturing a sensor having an ultra-high-frequency antenna printed on a receiving area on a first face of a printed circuit board. The first face of the board is inserted into a first housing portion with a seal and a compression element, the seal surrounding the receiving area while a first space remains free in the portion. A second face of the board is inserted into a second housing portion and the portions are pressed together, a second space remaining free. Then, polyurethane is injected into the first and second spaces, the seal preventing the polyurethane from penetrating into the receiving area.

12 Claims, 2 Drawing Sheets

(51) Int. Cl.

| | |
|---|---|
| ***H01Q 1/38*** | (2006.01) |
| *H01Q 1/22* | (2006.01) |
| *H01Q 1/42* | (2006.01) |

(56) References Cited

U.S. PATENT DOCUMENTS

| | | | | |
|---|---|---|---|---|
| 2015/0116171 | A1* | 4/2015 | Koga | H01Q 1/40<br>343/788 |
| 2017/0243422 | A1 | 8/2017 | Menard et al. | |
| 2019/0194983 | A1* | 6/2019 | Kalesse | E05B 79/06 |

OTHER PUBLICATIONS

English Translation of the Written Opinion for International Application No. PCT/FR2018/050319, dated May 4, 2018, 7 pages.

* cited by examiner

METHOD FOR MANUFACTURING A SENSOR PROVIDED WITH AT LEAST ONE ULTRAHIGH-FREQUENCY ANTENNA AND ULTRAHIGH-FREQUENCY SENSOR THUS OBTAINED

CROSS REFERENCE TO RELATED APPLICATIONS

This application is the U.S. National Phase Application of PCT International Application No. PCT/FR2018/050319, filed Feb. 9, 2018, which claims priority to French Patent Application No. 1751479, filed Feb. 24, 2017, the contents of such applications being incorporated by reference herein.

FIELD OF THE INVENTION

The invention relates to a method for manufacturing a sensor provided with at least one ultra-high-frequency antenna and at least one element associated with the antenna, and to an ultra-high-frequency sensor obtained in this way. In such a sensor, each antenna and the associated element thereof are printed on a receiving area on a first face of a printed circuit board.

The invention applies more particularly to "hands-free" systems for accessing and/or starting motor vehicles. A system referred to as a "hands-free" system for accessing a motor vehicle allows an authorized user to lock and/or unlock the doors of the vehicle or to start the vehicle without using a key.

For this purpose, the vehicle identifies a portable device such as a badge or remote control carried by the user and if the badge or the remote control is situated in a predetermined area around the vehicle and is identified as belonging to the vehicle, the vehicle automatically locks/unlocks its doors or starts depending on the user's intention, without the user having to use a key.

BACKGROUND OF THE INVENTION

This "hands-free" access system is known to a person skilled in the art. It is generally made up of an electronic control unit on board the vehicle, one or more radiofrequency antennas situated on the vehicle and an identification badge or remote control that comprises a radiofrequency antenna and is carried by the user.

The system also has capacitive sensors in the handles of the door in order that the vehicle unlocks the doors only when the user tries to enter it.

The identifier exchange is thus generally carried out via radiofrequency waves and by low frequency waves. The vehicle first transmits, via the low frequency antennas, a low frequency interrogation signal and the portable device, if it is situated within the reception area of said signal, that is to say a predetermined area around the vehicle, sends a radiofrequency presence message containing its identifier back to the vehicle.

The precise location of the portable device around the vehicle is determined by measuring the intensity of the low frequency signal, originating from the vehicle, received by the portable device via the antennas and the electronic control unit, these measurements more commonly being known as RSSI ("received signal strength indication") measurements, or by measuring the power of a signal received by an antenna on reception. The measurement of the power of the signal, originating from each low frequency antenna, received by the portable device is received and analyzed by a locating device on board the vehicle, which thus determines the position of the portable device with respect to said low frequency antennas, that is to say with respect to the vehicle.

More recently, consideration has been given to pairing a sensor with a portable device by ultra-high-frequency waves of between 2400 MHz and 2480 MHz, the access system thus obtained functioning similarly to a radiofrequency and low frequency access system.

This is because mobile telephones now employ the Bluetooth® or Bluetooth Low Energy communication standard, also known under the acronym "BLE", that is to say communication at ultra-high frequency (UHF) of from 2400 MHz to 2480 MHz. A mobile telephone may thus advantageously serve as a portable device in a "hands-free" system for accessing and/or starting a motor vehicle.

Furthermore, this communication standard also has the advantage of being universal. It is necessary for this communication standard to be approved for each country, in order to check that the device does not transmit excessively in the different frequency bands. By contrast, BLE certification, which checks the compatibility of the product with Bluetooth standards, can be carried out only once, in contrast to the current radiofrequency and low frequency communication standards in which the operating frequencies differ from country to country. Another advantage of the Bluetooth® communication standard is that it allows a large communication range of approximately 250 meters around the vehicle.

Such a sensor having an ultra-high-frequency antenna, which can be housed for example in a door handle of the motor vehicle, comprises in its interior a layer of polyurethane for ensuring the impermeability and the strength of the sensor.

However, the presence of polyurethane on an ultra-high-frequency antenna, one or more adaptation elements of the antenna and the tracks connecting the antenna printed on the printed circuit board and, the various adaptation elements, has a number of drawbacks:

The first drawback is mismatching of the antenna on account of polyurethane on the antenna, on the adaptation components or on the tracks between the components and the antenna. The performance of a poorly matched antenna is much worse.

The second drawback is attenuation of the signal transmitted by the antenna, which has to pass through a given thickness of polyurethane.

The third drawback is the lack of reproducibility of the method for manufacturing the sensor with variations in the parameters of the antenna from one sensor to another. Specifically, the heterogeneity of the polyurethane can cause variations in power of the signal transmitted by sensors of the same type.

SUMMARY OF THE INVENTION

The problem addressed by an aspect of the present invention is, for a sensor having an ultra-high-frequency antenna printed on a receiving area of a printed circuit board, wherein the sensor comprises an interior protective layer of polyurethane, to protect the receiving area from being covered by polyurethane, such covering entailing the above-mentioned drawbacks.

To this end, an aspect of the present invention relates to a method for manufacturing a sensor provided with at least one ultra-high-frequency antenna and at least one element associated with the antenna, said at least one antenna and said at least one element being printed on a receiving area on a first face of a printed circuit board, said method being noteworthy in that it comprises the following steps of:

inserting the first face of the printed circuit board into a first housing portion, a seal and a compression element for the seal being located within the first housing portion in a manner secured to a face of the first housing portion opposite the printed circuit board, the seal surrounding the receiving area while a first space remains free between said opposite face of the first housing portion and the printed circuit board, inserting a second face of the printed circuit board on the opposite side from the first face into a second housing portion complementary to the first housing portion, and pressing the first and second housing portions together, a second space remaining free between a face of the second housing portion opposite the printed circuit board and the board, injecting a layer of polyurethane into the first and second spaces, the seal preventing the polyurethane from penetrating into its interior in the receiving area that the seal delimits.

The technical effect is that of protecting at least one ultra-high-frequency antenna and the associated element(s) thereof from being covered with polyurethane. Such covering with polyurethane reduces the transmission and reception capabilities of the antenna.

The seal placed around the receiving area serves to protect the receiving area from polyurethane intruding into its interior. The compression element for the seal makes it possible to compress the latter in order to ensure the impermeability thereof and to withstand the pressure of the polyurethane injected all around the seal and the receiving area, which would tend to weaken the seal inside the receiving area. The seal and the compression element are secured, inside the first housing portion, to said opposite face of the first housing portion, advantageously an upper housing, thereby keeping it in position during the introduction of the printed circuit board into the first housing portion, during the pressing of the first and second housing portions together, and finally during the injection of the polyurethane.

Advantageously, before the first face of the printed circuit board is inserted into a first housing portion, the board is pierced all the way through by a hole, and, during the insertion of the first face of the board into the first housing portion, a part of the compression element passes into the hole, protruding beyond the second face of the board with a free-end portion, the free-end portion being flattened around the hole at the second face.

The compression element is already secured at one of its ends to the seal and said face of the first housing portion. This securing is complemented by the other end of the compression element being secured to the incorporated circuit board. The compression element is thus firmly in position during the execution of the manufacturing method according to an aspect of the present invention.

Advantageously, at least one fastening element carried by the first housing portion passes through the printed circuit board, a part of said at least one fastening element passing into a hole located outside the receiving area, said at least one fastening element protruding beyond the second face with a free-end portion, the free-end portion being flattened around the hole at the second face.

This makes it possible to reinforce the securing of the first housing portion to the printed circuit board. It is also possible to provide similar securing of the second housing portion to the printed circuit board.

Advantageously, before the first housing portion is closed by the second housing portion, a piece of foam is stuck to the second face on the reverse of the receiving area of the first face, the area of contact of the piece of foam on the second face of the board being more than or equal to 0 to 20% of the area of the receiving area of the first face of the board.

The disadvantage of piercing the printed circuit board with a hole is that it impairs the impermeability of the receiving area protected by the seal. Specifically, polyurethane injected onto the second face of the printed circuit board could pass into the receiving area through this hole. This can be avoided by the presence of a piece of foam stuck to the second face of the printed circuit board on the reverse of the receiving area and acting as an obstacle to the penetration of polyurethane into the hole.

Another advantage of the presence of a piece of foam is that it prevents the formation of a layer of polyurethane on the reverse of the receiving area, which could worsen the performance of the ultra-high-frequency antenna by mismatching of the antenna and wave absorption. The use of a piece of foam makes it possible to avoid these two drawbacks.

Advantageously, the first and second housing portions nest partially one in the other with free-edge portions of the housing portions overlapping, said free-edge portions being secured together by clip-fastening, laser welding or ultrasonic welding. The impermeability of the interior of the first and second housing portions and consequently of the sensor is ensured in this way. The edge portions overlap at the longitudinal ends of the sensor.

The system for fastening the housing portions together allows the impermeability to polyurethane during the injection thereof. It is the presence of polyurethane at the junction between the housing portions that allows impermeability to water.

Advantageously, at least said opposite face of the first housing portion or a face of the second housing portion opposite the printed circuit board has an inlet opening for injection of polyurethane forming a layer on the two faces of the printed circuit board, the layer of polyurethane passing around the seal and, if necessary, the piece of foam, a passage being left free between the innermost housing portion of the sensor and the printed circuit board for the injection of polyurethane into the first and second free spaces respectively above and below the first and second faces of the board.

The polyurethane injected through the opening fills, under pressure, the first and second free spaces inside the first and second housing portions. If there is a passage between the innermost free end of the housing and the facing edge of the printed circuit board, the polyurethane can spread over the first and second faces of the board. Therefore, a single opening in one first or second housing portion is sufficient. However, it is advantageous, to provide an outlet opening in order that excess polyurethane can leave the interior of the first and second housing portions. The outlet opening also makes it possible to expel air during filling through the first opening.

Advantageously, before the first face is inserted into the first housing portion, the first housing portion and the compression element are obtained by simultaneous molding, and the seal is overmolded on the first housing portion and on the compression element. The securing thus obtained is optimal and this securing is done during the molding of the first housing portion and therefore does not require any additional working time. The overmolding of the seal on the first housing portion and on the seal also makes it possible to obtain a firm hold of the compression element with respect to the first housing portion.

An aspect of invention also relates to a sensor provided with at least one ultra-high-frequency antenna and at least one element associated with the antenna, said at least one antenna and said at least one element being printed on a receiving area on a first face of a printed circuit board having first and second faces opposite one another, said sensor being noteworthy in that the sensor is manufactured in accordance with such a manufacturing method, the compression element being a snap-rivet having an elongate head extending perpendicularly to the first face of the board over the entire height of the seal between an end secured to the seal and to the first housing portion and an opposite end bearing against the receiving area, said opposite end of the head being prolonged by a pin passing through a hole made in the receiving area and passing right through the printed circuit board, a flattened free-end portion of the pin on the opposite side from the head pressing against a perimeter of the hole on the second face of the board.

The seal protects the receiving area from being covered with a layer of polyurethane. This makes it possible to ensure a space with low permittivity above the antenna or each antenna and the associated element(s) thereof in order to minimize the absorption and reflection of the ultra-high-frequency signals and to avoid poor matching.

A snap-rivet that passes through the printed circuit board and is held, for the one part, at one end on the first housing portion and, for the other part, at the other end on the printed circuit board is a compression element that is firmly in position and relatively economical.

The main obstacle to the development of a sensor having at least one ultra-high-frequency antenna, advantageously operating according to a Bluetooth® or Bluetooth Low Energy "BLE" communication standard, that is to say preferably for communication at ultra-high frequency (UHF) of 2400 MHz to 2480 MHz, was the presence of polyurethane on the antenna, greatly reducing the performance of the antenna.

An aspect of the present invention makes it possible to avoid this obstacle by protecting the receiving area of the antenna from being coated with a layer of polyurethane, causing the abovementioned drawbacks. An aspect of the present invention thus makes it possible to use such sensors notably in the automotive field, more particularly for a "hands-free" access system with, for the one part, an increase in the communication range of approximately 250 m around the vehicle compared with an access system with a radiofrequency antenna and, for the other part, the possible use of a mobile telephone as the portable control device.

Advantageously, the first and second housing portions have a U-shaped section in inverted positions with respect to one another, a second housing portion complementary to the first portion with an inverted U-shaped section facing a first housing portion with a non-inverted U-shaped section or vice versa, the free-edge portions of one housing portion being inserted between the free-edge portions of the other housing portion, fastening means securing the free-edge portions together.

Such a form of the first and second housing portions makes it possible to ensure the internal impermeability of the sensor through the obtaining of a maximum contact area between the first and second housing portions on account of the overlap of the end edges in addition to the securing thereof. A U-shape with a flat U bottom also makes it possible to rest the sensor ideally on a flat surface while it is being stored or to be fitted on a support member such as a member present in a motor vehicle.

An aspect of the invention finally relates to a member present in a motor vehicle, said member being noteworthy in that it has at least one sensor obtained by such a method or at least one such sensor. This member may be a motor vehicle door handle. The motor vehicle may have several members equipped with one or more sensors in order to determine the position of a portable device, which may be a mobile telephone, with respect to the motor vehicle.

BRIEF DESCRIPTION OF THE DRAWINGS

Further features, aims and advantages of aspects of the present invention will become apparent from reading the following detailed description and with reference to the appended drawings, which are given by way of nonlimiting examples and in which.

DETAILED DESCRIPTION OF THE PREFERRED EMBODIMENTS

Figure 1:
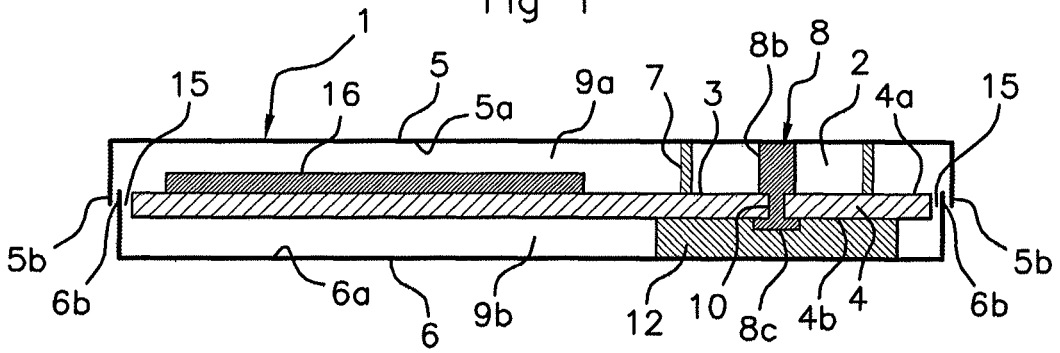
FIG. 1 is a schematic depiction of a view in longitudinal section of a sensor provided with at least one ultra-high-frequency antenna according to one embodiment of an aspect of the present invention, the sensor comprising a seal delimiting a receiving area for the antenna.

In the following text, reference is made to all the figures in combination. When reference is made to one or more specific figures, these figures are to be considered in combination with the other figures in order to ascertain the designated reference numerals. The terms "upper", "lower" and other references to spatial positions are understood with reference to the positioned components when the sensor is disposed horizontally with its printed circuit board extending substantially in a horizontal plane.

Referring notably more particularly to FIG. 1, an aspect of the present invention relates to a sensor 1 and to a method for manufacturing a sensor 1 provided with at least one ultra-high-frequency antenna 2 and with at least one element associated with the antenna 2.

An ultra-high-frequency antenna 2, or UHF antenna, is understood to be an antenna 2 for communication at a transmission frequency of 300 MHz to 3000 MHz, advantageously in accordance with a Bluetooth® or Bluetooth Low Energy, or "BLE", communication protocol, more particularly between 2400 and 2,483.5 MHz. The at least one element associated with the antenna 2 is understood to be an auxiliary element matched to the antenna 2, for example an impedance matching element, an element for exciting the tracks connecting the antenna 2 to the printed circuit board 4 and/or a control unit for the ultra-high-frequency antenna 2.

This or these ultra-high-frequency antenna(s) 2 with the auxiliary elements thereof is printed on a receiving area 3 on a first face 4*a* of a printed circuit board 4, this printed circuit board 4 incorporating the electronic elements for the operation of the sensor 1. Receiving area should be understood in a mechanical meaning, that is to say the area on which the antenna 2 is printed and not as meaning for receiving and transmitting waves, as is carried out by the antenna 2.

In FIG. 1, there may be electronic elements 16 that are also supported by the first face 4*a* of the printed circuit board 4, outside the receiving area 3. Electronic components may also be situated on the second face 4*b* of the printed circuit board 4.

In order to form a complete sensor 1, it is known practice to house the entire assembly made up of antennas 2, auxiliary elements and printed circuit board 4 in a protective housing 5, 6, polyurethane being injected into the housing 5, 6. There may be several antennas 2 grouped together or each having a respective receiving area 3.

Since the presence of polyurethane on each ultra-high-frequency antenna 2 can impair the communication of the antenna 2 toward the outside, an aspect of the present invention is intended to at least limit and advantageously prevent the coating of the antenna(s) 2 with polyurethane.

According to an aspect of the present invention, a step of inserting the first face 4*a* of the printed circuit board 4 into an upper housing 5 is carried out. While the figures show an upper housing 5 for the insertion of the first face 4*a* of the printed circuit board 4, this is not limiting and could also be the lower housing 6.

Throughout the following text, it is possible to replace upper housing 5 with lower housing 6 and vice versa. In the scope of an aspect of the invention, the first face 4*a* of the printed circuit board is inserted into a first housing portion 5 that is supplemented, in a subsequent step, by a second, complementary housing portion 6 so as to form a housing that completely and hermetically surrounds the printed circuit board 4 and the antenna 2 printed on the board 4. In the following text, the upper housing can thus be equated to a first housing portion and the lower housing to a second housing portion, the first and second housing portions being complementary in order to form a complete closed housing.

A seal 7 and a compression 8 for the seal 7 are located inside the first housing portion 5, being secured to an upper face 5*a* of the first housing portion 5 opposite the printed circuit board 4.

During the insertion of the first face 4*a* into the upper housing 5, the seal 7 surrounds the receiving area 3 in an impermeable manner. The compression element 8 for the seal 7 contributes toward the integrity of the seal 7 around the receiving area 3. A first space 9*a* remains free between the upper face 5*a* of the first housing portion 5 and the printed circuit board 4 outside the receiving area 3. This first space 9*a* is intended to be filled with polyurethane during a subsequent step.

Figure 2:
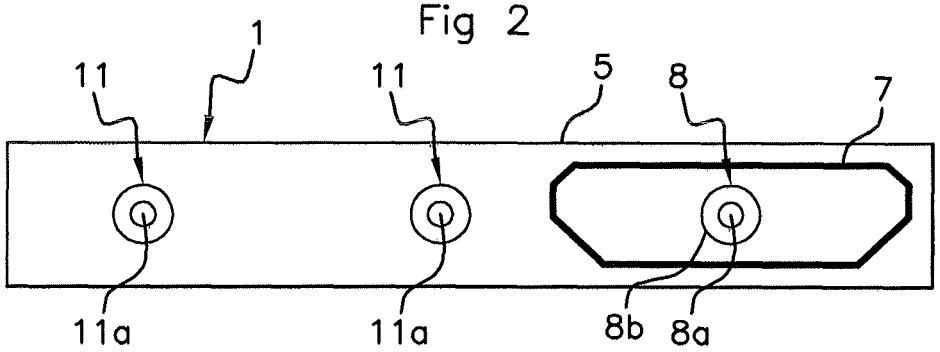
FIG. 2 is a schematic depiction of a bottom view of an upper housing intended to encase a printed circuit board that is part of a sensor according to one embodiment of an aspect of the present invention, the seal and a compression element for the seal being visible in this figure.

FIG. 2 illustrates a bottom view of the first housing portion 5 before the insertion of the printed circuit board 4 into the first housing portion 5. This figure shows the inside of an upper housing 5 of rectangular parallelepipedal shape with an open face, through which face the printed circuit board 4 is intended to be introduced into the upper housing 5.

In this FIG. 2, the seal 7 and the compression element 8 that are secured to the upper face 5*a* of the first housing portion 5 are visible, as are the fastening elements 11 intended for securing the first housing portion 5 to the printed circuit board 4.

These fastening elements 11, of which there are two in this FIG. 2, this not being limiting, are not essential to the implementation of an aspect of the present invention and will be described in more detail below.

Figure 3:
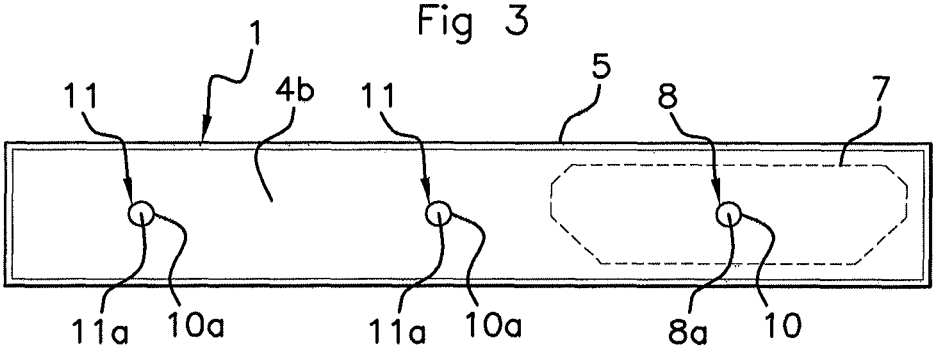
FIG. 3 is a schematic depiction of a bottom view of the printed circuit board housed in the upper housing that is part of a sensor according to a preferred embodiment of an aspect of the present invention, a portion of the compression element for the seal having passed through the board in this figure.

FIG. 3 illustrates a bottom view of the first housing portion 5 after the insertion of the printed circuit board 4 into the housing. In this figure, the compression element 8 and the fastening elements 11 pass through the printed circuit board 4 by way of respective pins 8*a*, 11*a* via respective holes 10, 10*a*.

Figure 4:
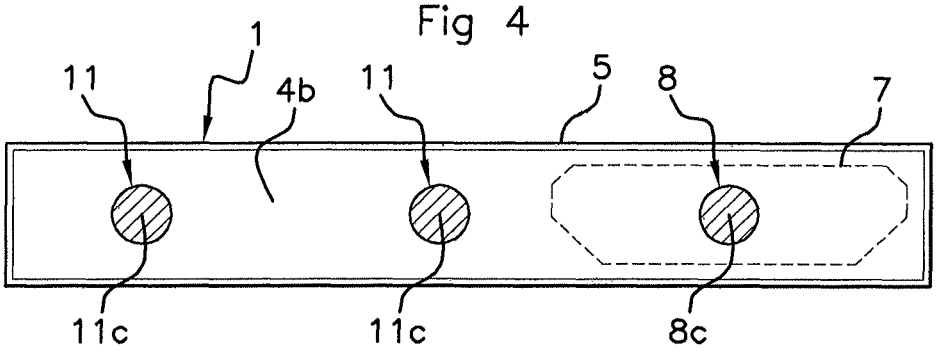
FIG. 4 is a schematic depiction of a bottom view of the printed circuit board housed in the upper housing that is part of a sensor according to a preferred embodiment of an aspect of the present invention, the free end of the portion of the compression element for the seal that has passed through the board being flattened against the printed circuit board in this figure.

FIG. 4 illustrates a bottom view of the first housing portion 5 after insertion of the integrated circuit board 4 into the housing 5 and of pins 8*a*, 11*a*, the free-end portion 8*c*, 11*c* of which has been flattened against the second face 4*b* of the printed circuit board 4. These passage characteristics of the compression element 8 and, if appropriate, of the fastening elements 11 through the printed circuit board 4 are not essential for implementing the method according to an aspect of the invention and will be described in more detail below.

Next, a step of inserting a second face 4*b* of the printed circuit board 4 on the opposite side from the first face 4*a* into a lower housing 6 is carried out. The upper and lower housings 5, 6 completely encase the assembly made up of the printed circuit board 4 and the antenna(s) 2 with the auxiliary elements thereof. This insertion step is followed by the lower and upper housings 5, 6 being pressed together and, advantageously, the facing edges 5*b*, 6*b* of the lower and upper housings 5, 6 being secured together.

A second space 9*b* remains free between a lower face 6*a* of the lower housing 6 opposite the printed circuit board 4 and the board 4. This second space 9*b* and the first space 9*a* are intended to be filled with polyurethane during a subsequent step of injecting polyurethane through the housing 5, 6, the injection being able to pass notably through the lower housing 6.

During this step of injecting a layer of polyurethane into the first and second spaces 9*a*, 9*b*, the seal 7 secured to the upper housing 5 and bearing against a perimeter of the receiving area 3, thus encasing the antenna(s) 2, prevents the polyurethane from penetrating inside the seal 7 and therefore into the receiving zone 3 that the seal 7 delimits. As a result, the antenna(s) 2 with the matching and exciting elements thereof are not coated with polyurethane and the abovementioned drawbacks are avoided.

The compression element 8 can pass through the printed circuit board 4 in order to hold it inside the seal 7. For example, before the insertion of the first face 4*a* of the board 4 into an upper housing 5, the printed circuit board 4 can be pierced all the way through by a hole 10. During the insertion of the first face 4*a* of the board 4 into the upper housing 5, a part of the compression element 8, advantageously in the form of a cylindrical pin 8*a*, can pass into the hole 10, protruding beyond the second face 4*b* of the board 4 with a free-end portion.

Before the upper and lower housings 5, 6 are pressed together, the free-end portion of the pin 8*a* can be pressed, giving a flattened free-end portion 8*c* around the hole 10 on the second face 4*b* of the board 4. This can be carried out using a flattening machine having free access to the free-end portion of the pin 8*a* and thus before the upper and lower housings 5, 6 are joined together.

This flattened free-end portion 8*c* of the pin 8*a* thus butts against an outlet of the pin 8*a* from the hole 10 in a movement toward the upper housing 5 of the compression element 8. The compression element 8 may have an elongate shape with a first end secured to the upper housing 5 and to the seal 7 and a second flattened end portion 8*c* butting against the second face 4*b* of the printed circuit board 4.

Figure 5:
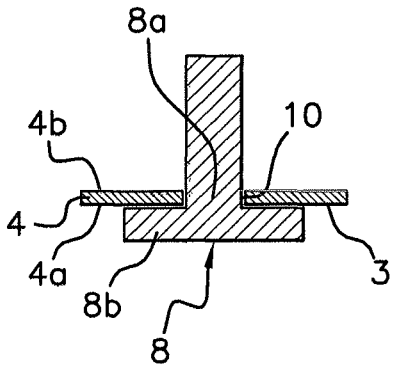
FIG. 5 and FIG. 6 are enlarged schematic depictions, compared with FIGS. 3 and 4, of a side view of the compression element for the seal, of which a portion that has passed through the printed circuit board is visible in these figures, the free end of the portion of the compression element for the seal that has passed through the board being shown in the non-flattened and flattened state, respectively, in these figures.
Figure 6:
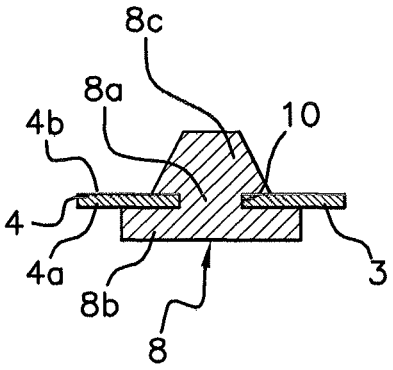

FIGS. 5 and 6 show a portion of a compression element 8 in the form of a pin 8*a* passing through a hole 10 in the printed circuit board 4 through the first face 4*a* of the board 4 and exiting through the second face 4*b*. In FIG. 5, the free-end portion of the pin 8*a* is not flattened and in FIG. 6, the free-end portion of the pin 8*a* has been flattened so as to form a flattened free-end portion 8*c* butting against the outlet of the pin 8*a* from the hole 10. In these FIGS. 5 and 6, the seal 7 is not shown.

In these FIGS. 5 and 6, with reference to FIG. 1 for the elements not illustrated in FIGS. 5 and 6, the compression element 8 is a snap-rivet with an elongate head 8*b*. In FIGS. 5 and 6, only a part of the head 8*b* adjacent to the pin 8*a* of the snap-rivet 8 is shown. As can be seen in FIG. 1, the head 8*b* can extend perpendicularly to the first face 4*a* of the board 4 over the entire height of the seal 7 between an end secured to the seal 8 and to the upper housing 5 and an opposite end bearing against the receiving area 3.

As mentioned above, the opposite end of the head 8*b* from the end secured to the seal 7 is prolonged by a pin 8*a* passing through a hole 10 made in the receiving area 3 and passing right through the printed circuit board 4.

This causes flattening of the end portion of the pin 8*a* into a flattened free-end portion 8*c* when the upper and lower housings 5, 6 are pressed together. As shown in FIG. 6, the flattened free-end portion 8*c* of the pin 8*a* opposite the head 8*b* bears against a perimeter of the hole 10 on the second face 4*b* of the board 4.

The snap-rivet 8 is thus prevented from moving back and forth in the hole 10 in the direction of the upper face 5*a* of the first housing portion 5 and of the lower face of the lower housing 6. This is caused both by the presence of the end of the head 8*b* bearing against the outlet of the hole 10 on the first face 4*a* of the board 4 and by the flattened free-end portion 8*c* of the pin 8*a* bearing against the outlet of the hole 10 on the second face 4*b* of the printed circuit board 4.

There may be one or more fastening elements 11 securing the upper housing 5 to the printed circuit board 4. This is shown for example in FIGS. 2 to 4. Similarly, there may be one or more fastening elements securing the lower housing 6 to the printed circuit board 4.

For example, at least one fastening element 11 carried by the upper housing 5 can pass through the printed circuit board 4. A part of said at least one fastening element 11 can pass into a hole 10*a*, which can be located outside the receiving area 3, said at least one fastening element 11 being located in a hole 10*a* and protruding beyond the second face 4*b* with a free-end portion 11*a* intended to be flattened in order to give a flattened free-end portion 11*c*. In the same way as for the flattened free-end portion 8*c* of the pin 8*a* of the compression element 8 for the seal 7, the portion 11*a* of the fastening element 11 can be pressed in order to form a flattened free-end portion 11*c* around the hole 10*a* against the second face 4*b* when the lower and upper housings 5, 6 are pressed together.

Before the second face 4*b* of the board 4 is inserted into the lower housing 6, a piece of foam 12 can be stuck to the second face 5*b* on the reverse of the receiving area 3 of the first face 4*a*. This piece of foam 12 both ensures impermeability of the hole 10 through which the compression means 8 passes and ensures the absence of polyurethane on the portion of the second face 4*b* of the board 4 that is located on the reverse of the receiving area 3, itself on the first face 4*a* of the printed circuit board 4.

In order to ensure these two functions, the area of contact of the piece of foam 12 on the second face 4*b* of the board 4 may be greater than or equal to 0 to 20% of the area of the receiving area 3 on the first face 4*a* of the board 4. The thickness of the piece of foam 12 may correspond to the thickness of the layer of polyurethane to be injected onto the second face 4*b* of the printed circuit board 4 and thus reach the lower face 6*a* of the lower housing 6 and even protrude beyond it after being compressed against the face 6*a* of the lower housing 6. The piece of foam 12 advantageously has a low density with large cells in order that the medium for the propagation of the signals has a relative permittivity close to 1.

The thickness of the piece of foam 12 can thus be advantageously greater than the distance between the board 4 and the lower housing 6. During the assembly of the lower housing 6, the foam is compressed. In this way, all the space between the board 4 and the lower housing 6 is certain to be taken up by the foam, thereby ensuring the absence of polyurethane. The compression of the piece of foam 12 may for example be around 30% for example in order to compensate for dimensional uncertainties.

As mentioned above, the upper and lower housings 5, 6 can nest partially one in the other with free-edge portions 5*b*, 6*b* of the housings overlapping 5, 6, facing one another in the plane of the printed circuit board 4 of the sensor 1.

As can be seen notably in FIG. 1, the upper and lower housings 5, 6 can have a U-shaped section in inverted positions with respect to one another with a flat bottom of the U. Each upper housing 5 and lower housing 6 can be in the shape of a rectangular parallelepiped or a shape derived from a rectangular parallelepiped with the face of the parallelepiped turned toward the printed circuit board 4 open. However, other, more complex shapes can be used in order to fit a member to which the sensor 1 is secured, for example a motor vehicle door handle.

A lower housing 6 or upper housing 5 with an inverted U-shaped section can face an upper housing 5 or lower housing 6 with a non-inverted U-shaped section. In FIG. 1, the upper housing 5 has an inverted U-shaped section and the lower housing 6 has a non-inverted U-shaped section, this not being limiting. When the upper and lower housings 5, 6 are pressed together, the free-edge portions 6*b* of one housing 6 can be inserted between the free-edge portions 5*b* of the other housing 5, fastening means securing the free-edge portions 5*b*, 6*b* together. For reasons of impermeability and water flow over the exterior of the sensor 1, it is advantageous for it to be the free-edge portion 6*b* of the lower housing 6 that is inserted partially into the free-edge portion 5*b* of the first housing portion 5. This depends on the possibilities of mechanical integration.

For example, the free-edge portions 5*b*, 6*b* can be secured, together by clip-fastening, laser welding or ultrasonic welding or any other means ensuring impermeability between the upper and lower housings 5, 6 and thus for the sensor 1.

Figure 7:
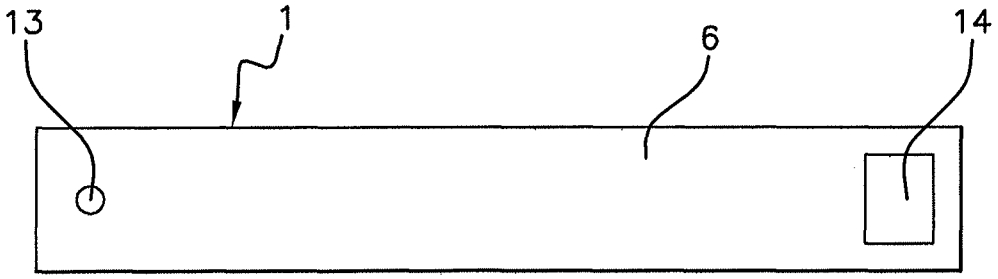
FIG. 7 is a schematic depiction of a bottom view of a lower housing intended to encase the other face of the printed circuit board than that encased by the upper housing, the lower housing being part of a sensor according to a preferred embodiment of an aspect of the present invention, an opening for the injection of polyurethane into the housings and a polyurethane reservoir being visible in this figure.

For the step of injecting polyurethane into the first and second free spaces 9*a*, 9*b* inside the upper and lower housings 5, 6, as is shown in FIG. 7 for the lower housing 6, with reference also to FIG. 1, at least an first face 5*a* of the first housing portion 5 or a lower face 6*a* of the lower housing 6 can have an inlet opening 13 for injecting polyurethane forming a layer on the two faces 4*a*, 4*b* of the printed circuit board 4.

According to an aspect of the present invention, the layer of polyurethane can pass around the seal 7 and, if it is present, the piece of foam 12. FIG. 7 also shows a polyurethane reservoir 14 on the outside of the sensor 1 during the injection step, polyurethane escaping from the sensor 1 and being collected in this reservoir 14 that is part of the system for injecting polyurethane and will be detached from the sensor 1 after the injection step.

As can be seen in FIG. 1, a passage 15 may be left free between the innermost free-end edge 6*b* of the housing 6 of the sensor 1 and the printed circuit board 4 for the injection of polyurethane into the first and second free spaces 9*a*, 9*b* respectively above and below the first and second faces 4*a*, 4*b* of the board 4. The polyurethane injected into one of the two housings 5, 6 can thus flow into the other housing 6, 5 through this passage 15.

It has been mentioned above that the seal 7 and the compression element 8 are secured to the upper housing 5, advantageously the upper face 5*a* of the first housing portion 5. This can take place before the first face 4*a* is inserted into the upper housing 5.

The upper housing 5 and the compression element 8 can be obtained by simultaneous molding. In this case, the upper housing 5 and the compression element 8 are in one piece, advantageously being made of the same material. The seal 7 can then be overmolded on the upper housing 5 and on the compression element 8 that have been molded together.

For example, the material of the compression element 8 and advantageously of the upper and lower housings 5, 6 can be made of polymer PA612 and the material of the seal can be made of a thermoplastic elastomer or TPE of the type Kraiburg TCSPCZ 45 shoreA or an equivalent plastic elastomer. The height of the seal 7 may be 3 mm and the compression by the compression element 8 may be effected over 0.5 mm. This is not limiting. The seal 7 may have a substantially trapezoidal shape, as shown in FIG. 2. A rectangular, square or other shape, such as polygonal, is also possible.

An aspect of the invention also relates to a sensor 1 provided with at least one ultra-high-frequency antenna 2 and at least one element associated with the antenna 2, as mentioned above and obtained by a manufacturing method as described above.

A particularly advantageous application of such an ultra-high-frequency sensor 1 is in a member present in a motor vehicle, for example a handle of a door present in the motor vehicle. It is possible to provide several ultra-high-frequency sensors 1 for one and the same motor vehicle, the set of sensors 1 being able to make it possible to locate a portable device around the vehicle. Further applications, in the automotive field or in other fields, are also possible.

The invention claimed is:

1. A method for manufacturing a sensor provided with at least one ultra-high-frequency antenna and at least one element associated with the antenna, said at least one antenna and said at least one element being printed on a receiving area on a first face of a printed circuit board, the method comprising:

inserting the first face of the printed circuit board into a first housing portion, a seal and a compression element for the seal being located within the first housing portion in a manner secured to a face of the first housing portion opposite the printed circuit board, the seal surrounding the receiving area while a first space remains free between said opposite face of the first housing portion and the printed circuit board, inserting a second face of the printed circuit board on an opposite side from the first face into a second housing portion complementary to the first portion, and pressing the first and second housing portions together, a second space remaining free between a face of the second housing portion opposite the printed circuit board and the board, injecting a layer of polyurethane into the first and second spaces, the seal preventing the polyurethane from penetrating into its interior in the receiving area that the seal delimits.

2. The method as claimed in claim 1, wherein, before the first face of the printed circuit board is inserted into a first housing portion, the board is pierced all the way through by a hole, and, in that, during the insertion of the first face of the board into the first housing portion, a part of the compression element passes into the hole, protruding beyond the second face of the board with a free-end portion, the free-end portion being flattened around the hole at the second face.

3. The method as claimed in claim 1, wherein at least one fastening element carried by the first housing portion passes through the printed circuit board, a part of said at least one fastening element passing into a hole located outside the receiving area, said at least one fastening element protruding beyond the second face with a free-end portion, the free-end portion being flattened around the hole at the second face.

4. The method as claimed in claim 1, wherein, before the first housing portion is closed by the second housing portion, a piece of foam is stuck to the second face on the reverse of the receiving area of the first face, the area of contact of the piece of foam on the second face of the board being more than or equal to 0 to 20% of the area of the receiving area of the first face of the board.

5. The method as claimed in claim 1, wherein the first and second housing portions nest partially one in the other with free-edge portions of the housing portions overlapping, said free-edge portions being secured together by clip-fastening, laser welding or ultrasonic welding.

6. The method as claimed in claim 5, wherein at least said opposite face of the first housing portion or a face of the second housing portion opposite the printed circuit board has an inlet opening for injection of polyurethane forming a layer on the two faces of the printed circuit board, the layer of polyurethane passing around the seal and, if necessary, the piece of foam a passage being left free between the innermost housing portion of the sensor and the printed circuit board for the injection of polyurethane into the first and second free spaces respectively above and below the first and second faces of the board.

7. The method as claimed in claim 1, wherein, before the first face is inserted into the first housing portion, the first housing portion and the compression element are obtained by simultaneous molding, and the seal is overmolded on the first housing portion and on the compression element.

8. A sensor provided with at least one ultra-high-frequency antenna and at least one element associated with the antenna, said at least one antenna and said at least one element being printed on a receiving area on a first face of a printed circuit board having first and second faces opposite one another, wherein the sensor is manufactured in accordance with a manufacturing method according to claim 1, the compression element being a snap-rivet having an elongate head extending perpendicularly to the first face of the board over the entire height of the seal between an end secured to the seal and to the first housing portion and an opposite end bearing against the receiving area, said opposite end of the head being prolonged by a pin passing through a hole made in the receiving area and passing right through the printed circuit board, a flattened free-end portion of the pin on the opposite side from the head pressing against a perimeter of the hole on the second face of the board.

9. The sensor as claimed in claim 8, wherein the first and second housing portions have a U-shaped section in inverted positions with respect to one another, a second housing portion complementary to the first portion with an inverted U-shaped section facing a first housing portion with a non-inverted U-shaped section or vice versa, the free-edge portions of one housing portion being inserted between the free-edge portions of the other housing portion, fastening means securing the free-edge portions together.

10. A member present in a motor vehicle, comprising at least one sensor obtained by a method as claimed in claim 1.

11. The method as claimed in claim 2, wherein at least one fastening element carried by the first housing portion passes through the printed circuit board, a part of said at least one fastening element passing into a hole located outside the receiving area, said at least one fastening element protruding beyond the second face with a free-end portion, the free-end portion being flattened around the hole at the second face.

12. A member present in a motor vehicle, comprising at least one sensor as claimed in claim 8.

* * * * *